US011319684B1

(12) United States Patent
Gross et al.

(10) Patent No.: US 11,319,684 B1
(45) Date of Patent: May 3, 2022

(54) METHOD AND APPARATUS FOR ANIMAL WASTE COLLECTION

(71) Applicant: PROVIDENTIAL INNOVATIONS, LLC, Fort Mill, SC (US)

(72) Inventors: Robert R. Gross, Nisswa, MN (US); Dorothy J. Gross, Nisswa, MN (US)

(73) Assignee: PROVIDENTIAL INNOVATIONS, LLC, Fort Mill, SC (US)

( * ) Notice: Subject to any disclaimer, the term of this patent is extended or adjusted under 35 U.S.C. 154(b) by 266 days.

(21) Appl. No.: 16/746,438

(22) Filed: Jan. 17, 2020

Related U.S. Application Data

(63) Continuation-in-part of application No. 16/669,232, filed on Oct. 30, 2019, now Pat. No. 11,162,235.

(51) Int. Cl.
*E01H 1/00* (2006.01)
*E01H 1/12* (2006.01)

(52) U.S. Cl.
CPC ..... *E01H 1/1206* (2013.01)

(58) Field of Classification Search
CPC ..... E01H 1/1206; E01H 2001/128; E01H 2001/1226
See application file for complete search history.

(56) References Cited

U.S. PATENT DOCUMENTS

| | | | | |
|---|---|---|---|---|
| 1,485,172 | A | 2/1924 | Dowell | 206/581 |
| 3,567,013 | A | 3/1971 | Tannebaum | 206/42 |
| 3,580,650 | A | 5/1971 | Morris | 312/7 |
| 3,933,296 | A | 1/1976 | Ruskin et al. | 229/2.5 |
| 3,999,661 | A | 12/1976 | Jones | 206/591 |
| 4,205,869 | A | 6/1980 | Mathis | 294/1 |
| 4,653,685 | A | 3/1987 | Leary et al. | 229/2.5 |
| D290,416 | S | 6/1987 | Breuer | D30/99 |
| 4,787,552 | A | 11/1988 | Natori | 229/2.5 |
| 4,896,912 | A | 1/1990 | Parnell | 294/1.3 |
| 4,917,238 | A | 4/1990 | Schumacher | 206/223 |
| 4,989,728 | A | 2/1991 | Neyret et al. | 206/91 |
| 5,139,140 | A | 8/1992 | Burrows et al. | 206/268 |
| 5,300,748 | A | 4/1994 | Colombo | 219/734 |
| D353,327 | S | 12/1994 | Castner et al. | D9/425 |
| 5,810,234 | A * | 9/1998 | Burli | A47F 9/042 225/106 |
| 5,884,771 | A | 3/1999 | McCormick | 206/581 |
| 5,909,832 | A * | 6/1999 | French | B60S 1/66 224/547 |
| 5,931,304 | A | 8/1999 | Hammond | 206/570 |
| 5,950,834 | A | 9/1999 | Woodnorth et al. | 206/541 |
| 6,283,405 | B1 * | 9/2001 | Tracy | B65D 83/0805 206/390 |
| 6,609,627 | B1 | 8/2003 | Clarke | 220/592.2 |
| 6,641,306 | B1 | 11/2003 | Knoerzer et al. | 383/38 |

(Continued)

OTHER PUBLICATIONS

Office Action issued in U.S. Appl. No. 16/669,232, dated Feb. 18, 2021, 23 pages.

(Continued)

*Primary Examiner* — Paul T Chin
(74) *Attorney, Agent, or Firm* — Hayes Soloway P.C.

(57) ABSTRACT

A compact animal waste collector kit includes a hinged lid receptacle which is sized and shaped to be hand-held and support an animal waste bag; and an animal waste bag sized and shaped to fit over an open end of the hinged lid receptacle and in the hinged lid receptacle.

13 Claims, 14 Drawing Sheets

(56) References Cited

U.S. PATENT DOCUMENTS

| | | | | |
|---|---|---|---|---|
| 6,971,697 | B2 * | 12/2005 | Morales | B60N 3/08 296/37.1 |
| 7,648,024 | B2 | 1/2010 | Mitten et al. | 206/236 |
| 8,128,287 | B2 * | 3/2012 | Song | B65D 31/04 383/4 |
| D683,210 | S | 5/2013 | Cox et al. | D9/420 |
| 8,523,049 | B2 | 9/2013 | Fitzwater | 229/146 |
| 8,544,414 | B1 | 10/2013 | Gross et al. | 119/170 |
| 8,833,816 | B2 | 9/2014 | Hoffman | 294/1.3 |
| 9,565,836 | B2 | 2/2017 | Conley | A01K 27/008 |
| 10,314,277 | B2 | 6/2019 | Stephens | A45C 13/26 |
| 10,611,549 | B1 | 4/2020 | Mahon | B65D 81/32 |
| 2003/0154931 | A1 | 8/2003 | Ostrowiecki | A01K 27/00 |
| 2004/0124646 | A1 | 7/2004 | Peko | A01K 29/00 |
| 2005/0264016 | A1 | 12/2005 | Davis | A01K 29/00 |
| 2008/0265592 | A1 | 10/2008 | Askinasi | A01K 29/00 |
| 2012/0153648 | A1 | 6/2012 | Lacer | A01K 29/00 |

OTHER PUBLICATIONS

Office Action issued in U.S. Appl. No. 16/669,232, dated Jul. 9, 2021, 22 pages.
U.S. Appl. No. 16/669,232, filed Oct. 30, 2019, Gross.

* cited by examiner

METHOD AND APPARATUS FOR ANIMAL WASTE COLLECTION

CROSS REFERENCE TO RELATED APPLICATIONS

This application is a continuation-in-part (CIP) application of my co-pending U.S. application Ser. No. 16/669,232, filed Oct. 30, 2019, the contents of which are incorporated herein by reference.

FIELD OF THE DISCLOSURE

The present disclosure is generally related to waste collection and more particularly is related to a method and system for animal waste collection.

BACKGROUND OF THE DISCLOSURE

In many communities throughout the world, it is unlawful to allow an animal to mess or pass waste on public property or another's private property and not clean it up after. Animal waste, primarily fecal matter from dogs, is unsanitary and is considered a nuisance when it is not cleaned up after. However, an animal owner who must clean up after their pet faces the unpleasant task of removing the waste and disposing of it. Often, this is required in remote locations, such as in a park or on a neighbor's yard and proper disposal isn't immediately available. The owner is forced to use a waste container, usually consisting of a plastic bag, to collect the waste and carry and store it until proper disposal is available.

Handling the waste of an animal is often considered a very unpleasant task because it includes many unpleasant aspects, such as seeing the waste, feeling the waste through the container and smelling an odor from the waste. The texture of the waste after being passed by an animal is often squishy and conforms to the container that it is being picked up in. Thus, it is undesirable for an owner to use a flexible plastic bag to clean up the waste, because the owner will be able to feel the squishy texture of the waste through the bag. Once the waste is collected, the animal's owner may still be subject to the odor of the waste for the remainder of the excursion, or the visual sight of the waste through the bag. These unpleasant aspects of cleaning up animal waste often result in owners neglecting to clean up the waste, or the waste being improperly disposed of.

The foregoing discussion of the prior art primarily derives from our earlier U.S. Pat. No. 8,544,414 in which we describe a system and method for a compact animal waste collector system and method, as follows. The collector includes a substantially planar base having a first side and a second side. A plurality of walls are affixed to the base and positioned substantially perpendicular to the base. A substantially planar first cover is hinged to at least one of the plurality of walls, whereby to form an interior compartment proximate to the first side of the base and movable between at least a first position and a second position, wherein the first cover in the first position substantially encloses the interior compartment, and the first cover in the second position forms at least one opening in the interior compartment. A bag is removably located at least partially within the collector and lines the interior compartment, wherein the bag has an opening edge inverted about at least a portion of an exterior of the collector thereby providing access to an inside surface of the bag. The collector is sized to house a quantity of animal waste within the interior compartment. A storage compartment is formed on the second side of the base and is enclosable by the plurality of walls and a substantially planar second cover hinged to at least one of the plurality of walls. The storage compartment also is sized to house at least one replacement bag. In use, a bag is fitted to the collector, and the collector with the exposed inside surface of the bag is positioned proximate to animal waste. The animal waste is moved into the interior compartment, and the cover is moved from the second position to the first position, thereby enclosing the quantity of animal waste within the interior compartment.

SUMMARY OF THE DISCLOSURE

The present disclosure provides an improvement over the compact animal waste collector and method described in our aforesaid U.S. Pat. No. 8,544,414 by providing an animal waste collector kit which comprises a pocket-sized, hand held collector device or receptacle which is sized and shaped to support an animal waste bag. In use, the animal waste collection device is placed in an open configuration adjacent the animal waste with an animal waste bag disposed on and within the animal waste is swept into the device, and or is placed over the animal waste and the device, and the device is snapped shut over the waste whereby to capture the animal waste within the bag. In one preferred embodiment, the device includes a separate compartment for storing spare bags and/or rigid cards to assist in loading the animal waste into the bags. In another preferred embodiment, the device includes a hinged lid configured to hold a supply of spare bags.

BRIEF DESCRIPTION OF THE DRAWINGS

Other features and advantages of the present disclosure will become apparent upon examination of the following drawings and taken in conjunction with the detailed description, in which like numerals depict like parts, and wherein.

DETAILED DESCRIPTION OF THE DISCLOSURE

Figure 1:
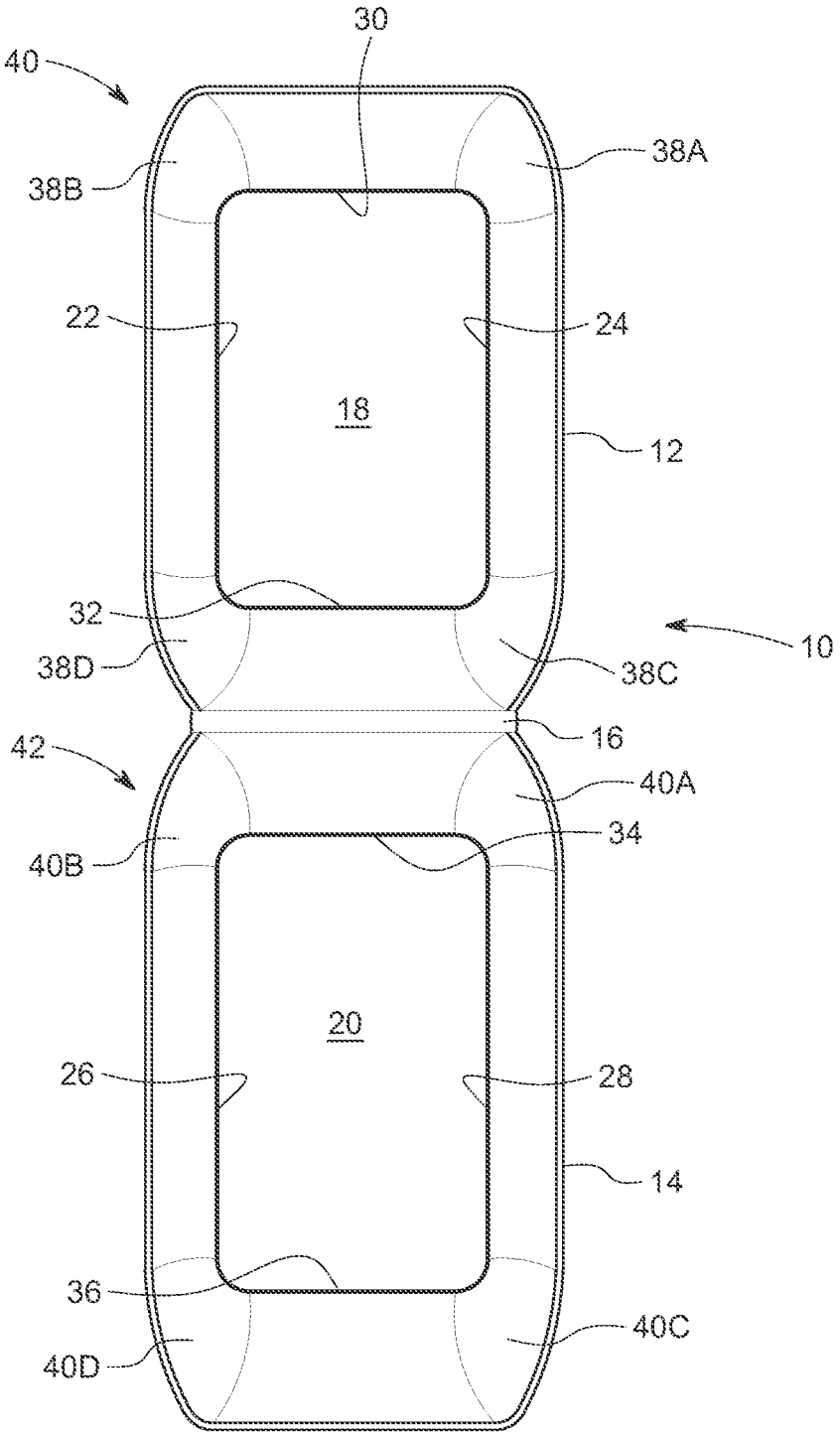
FIG. 1 is a plan view showing a first embodiment of animal waste collector in an open position.
Figure 2:
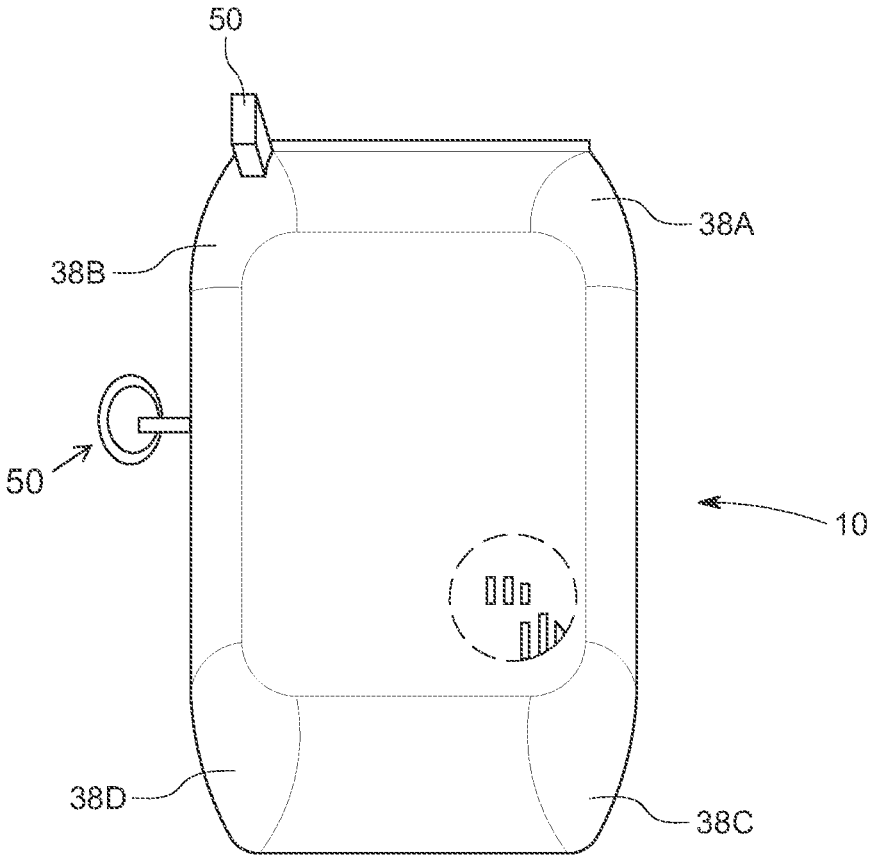
FIG. 2 is a plan view of the first embodiment of animal waste collector in a closed position.

Referring to FIGS. 1-3 in accordance with the first embodiment of the present disclosure, a compact animal waste collector device 10 is in the form of clamshell configuration receptacle comprising first and second halves 12, 14 hingedly connected together by a living hinge 16. Each half 12 and 14 includes solid back walls 18 and 20, respectively, side walls 22, 24 and 26, 28, respectively and end walls 30, 32 and 34, 36, respectively. The top edges 40, 42 of halves 12 and 14 are flat, or one edge may be shaped, for example, with a boss to engage with a slot or step on the other half. Walls 22, 24, 30 and 32, are configured in a generally rectangular fashion and walls 26, 28, 34 and 36 are arranged in a similar rectangular fashion. As closed, as illustrated in FIG. 2, animal waste collector device 10 has a generally cuboid shape, although the edges and corners 38A, 38B, 38C, 38D, and 40A, 40B, 40C, 40D respectively are rounded so that the animal waste collector device 10 may fit or be easily slid in and out of a person's pocket. The animal waste collector device 10 preferably is formed of molded plastic, and should be sized to fit easily in a person's hand and also a person's pocket, e.g., slightly larger than a cigarette pack. Larger dogs may require a larger collector device, but the device may still be sized small enough to fit within larger pockets, such as that of an inside jacket pocket.

Figure 3A:
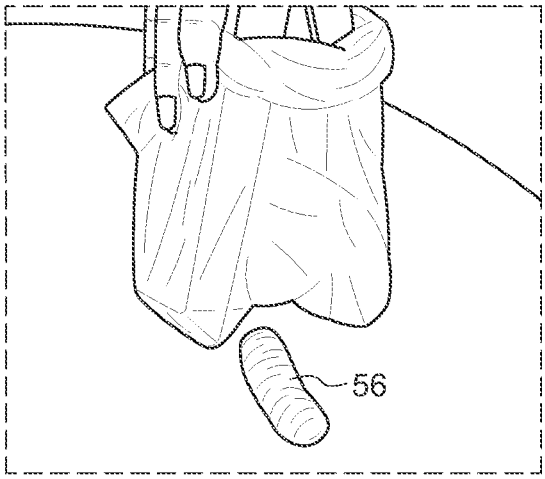
FIGS. 3A-3C show use of the animal waste collector of FIG. 1 and FIG. 2.
Figure 3B:
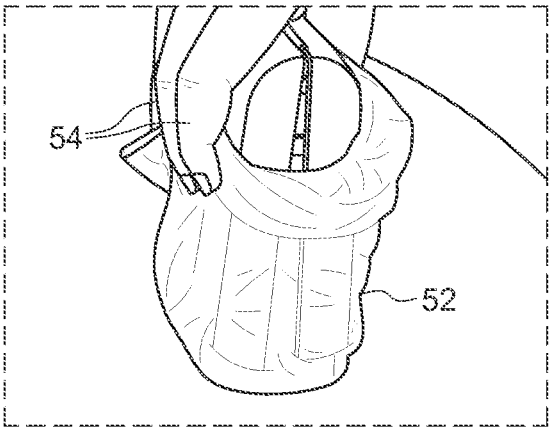
Figure 3C:
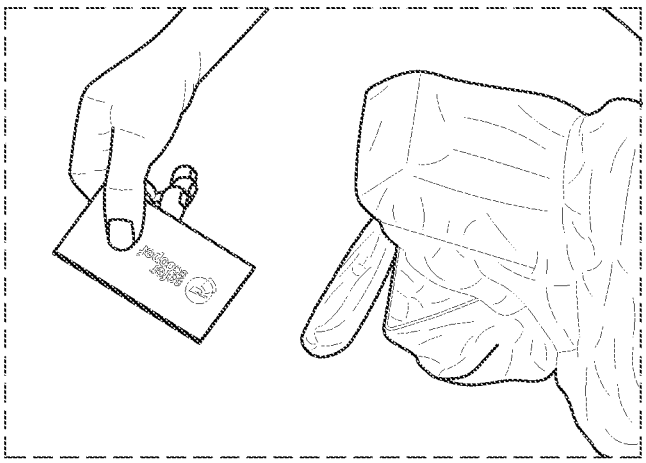

Referring to FIGS. 3A-3C, in use, the animal waste collector device 10 is partially opened and an animal waste bag 52 is slipped loosely over and in the animal waste collector device 10, and held in place by the fingers 54 of the person using the animal waste collector device. The animal waste collector device 10 is then positioned over the animal waste droppings 56 and the collector device is then snapped shut (see FIG. 3B) capturing the waste within the bag. In essence the animal waste collector device 10 acts as an extension of the user's hand, allowing the user to pick up the animal waste without having to feel the waste. The user may then slip the bag 52 off the collector device 10 and tie the bag or twist or fold it shut. The animal waste collector device 10 carrying the closed bag may then be closed or snapped shut, and slipped into the pocket of the user for later disposal.

Alternatively, as seen in FIG. 3C, when a dog may drop waste in more than one place, the waste may be collected by sliding the waste into an open animal waste collector device 10, using, for example, a waste paddle or rigid card 56. The animal waste collector device 10 then may be closed or snapped shut, and the bag folded over, tied or twisted shut for subsequent disposal. Of course, the waste paddle or card may be dropped into the bag before the bag is closed and the animal waste collector device 10 is closed or snapped shut.

Figure 4:
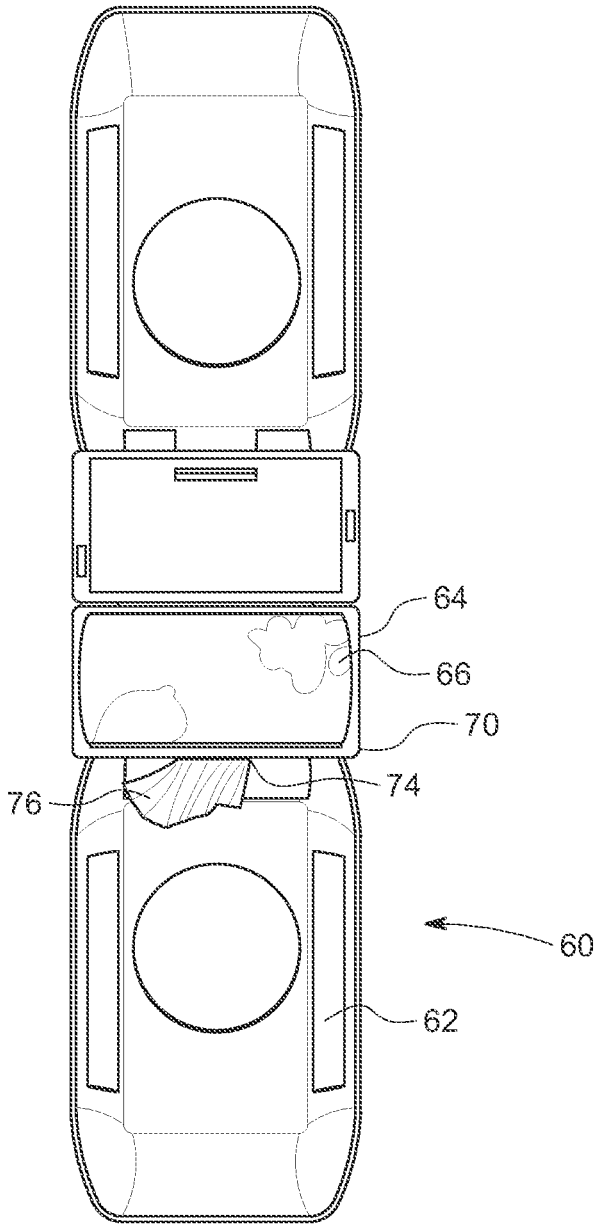
FIG. 4 is a view similar to FIG. 1 of a second embodiment of animal waste collector in an open position in accordance with the present disclosure.
Figure 5:
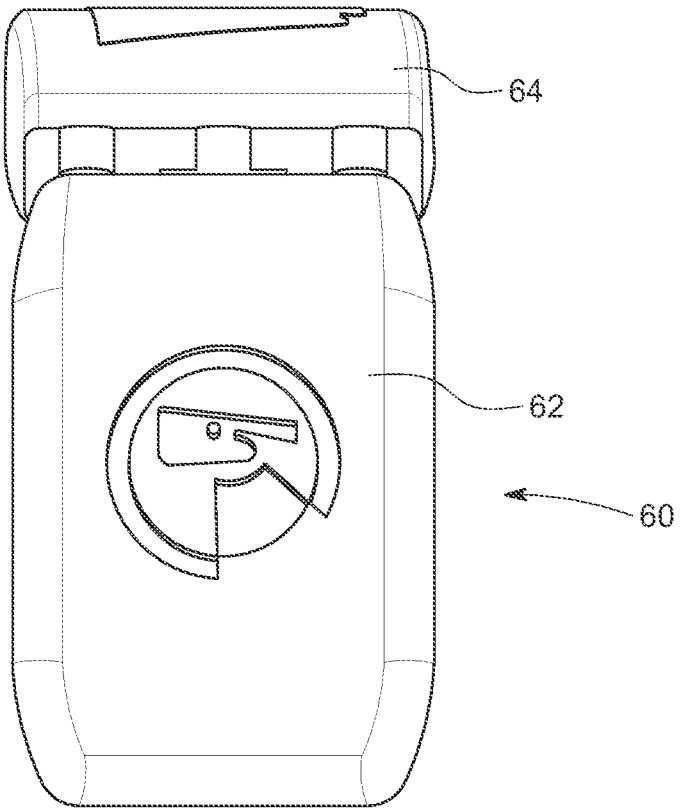
FIG. 5 is a view similar to FIG. 2 of the animal waste collector of FIG. 4 in a closed position.

Referring now to FIGS. 4 and 5, there is shown another embodiment of an animal waste collector device in accordance with the present disclosure. The embodiment of FIGS. 4 and 5 is similar to the animal waste collector device shown in FIGS. 1-3, and as such the animal waste collector device 60 of FIGS. 4 and 5 is clamshell-like, and includes a first animal waste compartment 62 similar in shape and size to animal waste collector device 10 of FIGS. 1-3. However, animal waste collector device 60 includes a second compartment 64 fixed to or integrally formed at one end of compartment 62. Compartment 66 is sized and shaped to hold a supply of plastic bags 66, preferably as a roll of plastic bags. Compartment 62 and compartment 64 share a common wall 70 which wall has a hole or slot 74 through which is threaded one end 76 of a plastic bag 66. In use, a person grabs the end 76 of the bag 66, and pulls the bag 66 out and breaks the bag along a perforated line from an adjoining bag. Alternatively, the several bags may be fold/stacked on one another, i.e., similar to a box of tissues. The bag may then be disposed over and in the animal waste collecting compartment 62, and used to pick up animal droppings as before as discussed and illustrated in FIGS. 3A-3C.

When the roll of bags 66 is depleted, the animal waste collector device 60 may be refilled with a fresh roll. Alternatively, a new animal waste collector device preloaded with bags may be acquired.

Figure 6:
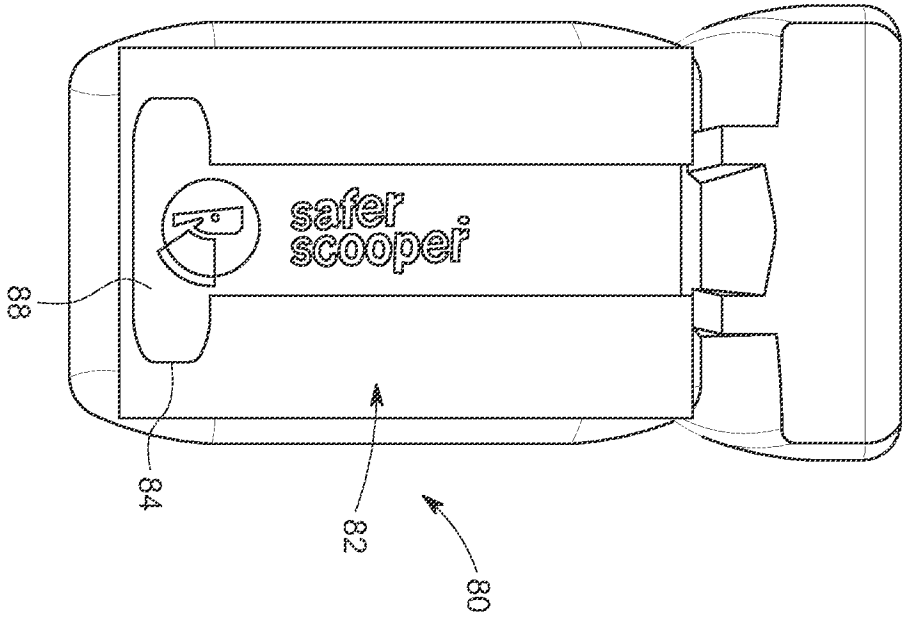
FIG. 6 is a plan view of yet another embodiment of animal waste collector in accordance with the present disclosure.

Yet another embodiment of animal waste collector device 80 in accordance with the present disclosure is shown in FIG. 6. The FIG. 6 animal waste collector device 80 is similar to the animal waste collector device 60 shown in FIGS. 4 and 5. However, one outside surface of the collecting compartment, for example, surface 82 is provided with a slotted frame 84 sized to accommodate a supply of waste paddles or rigid cards 88. Waste paddles or rigid cards 88 typically may be approximately the size of a standard business card and should have sufficient rigidity so that it may be used to help scoop or sweep the animal waste into the animal waste collector device 80.

Figure 7:
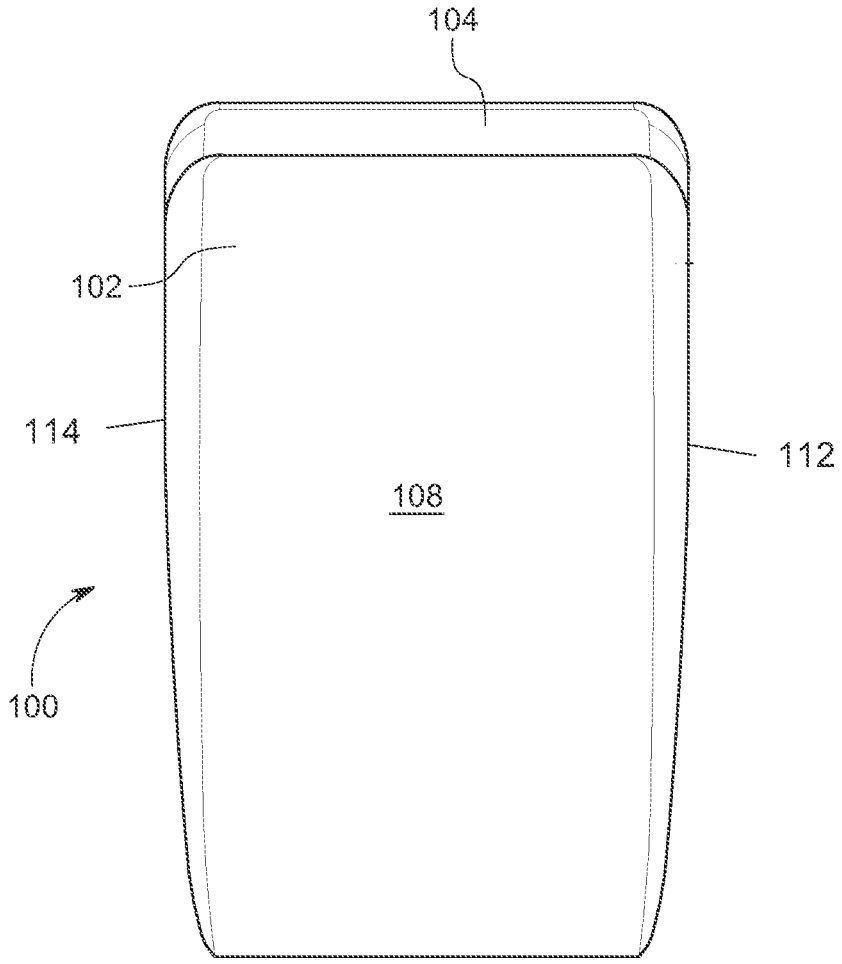
FIG. 7 is a plan view of yet another embodiment of animal waste collector in accordance with the present disclosure.
Figure 8:
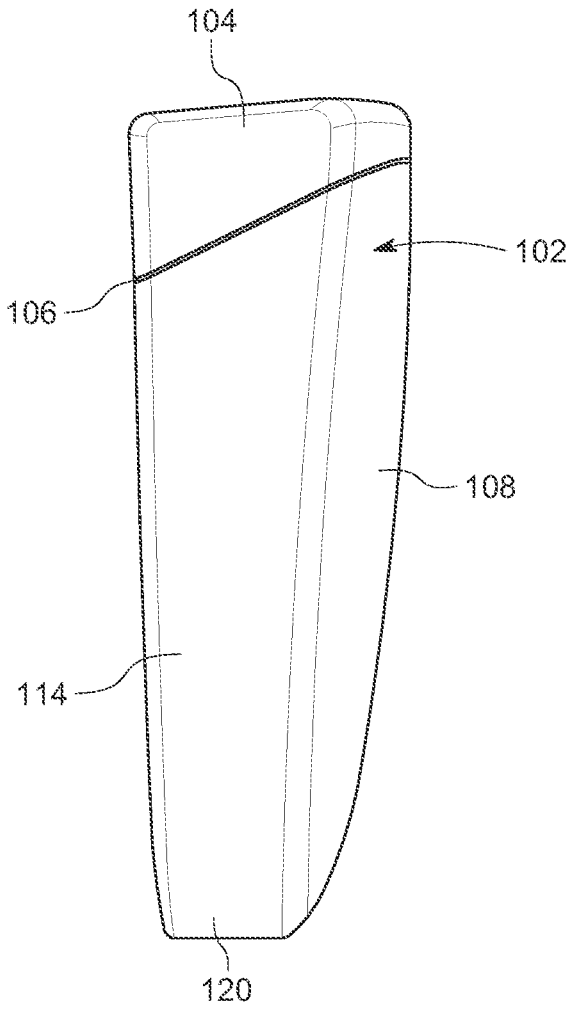
FIG. 8 is side elevational view of the animal waste collector of FIG. 7 in a closed position, showing the animal waste collector in a closed container.
Figure 9:
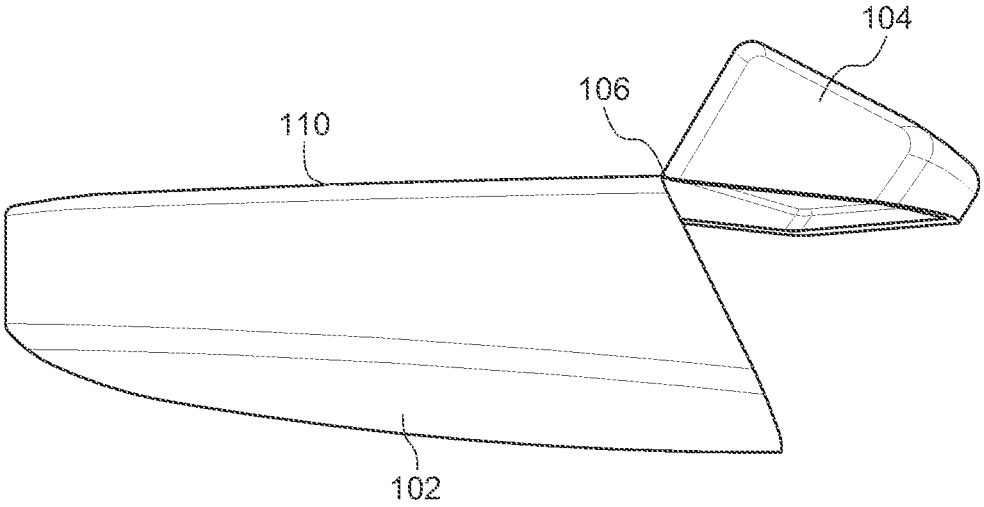
FIG. 9 is a view similar to FIG. 8, showing the animal waste collector of FIG. 7 in an open position.

Referring to FIGS. 7-9, in yet another embodiment, the animal waste collector device 100 comprises a hinged lid device that includes a body portion 102 and a lid portion 104. Lid portion 104 is attached to body portion 102 by a living hinge 106.

Figure 10:
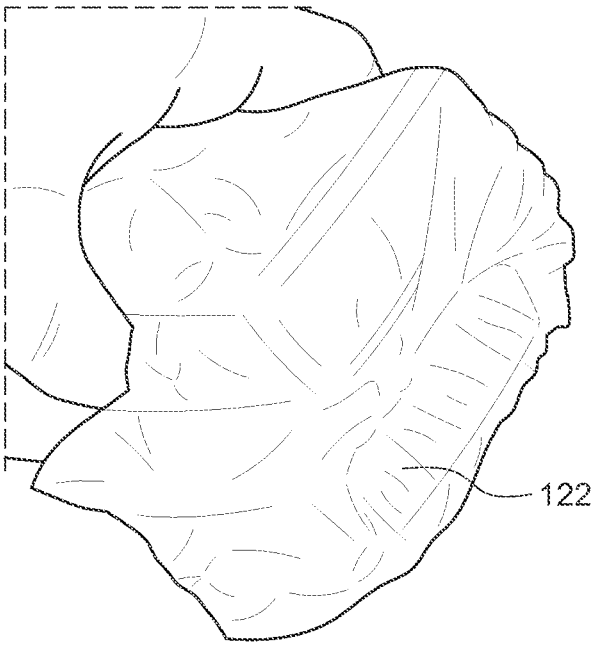
FIG. 10 is a perspective view of the animal waste collector of FIG. 7 with a waste bag disposed over and in the animal waste collector, and ready for use.
Figure 11:
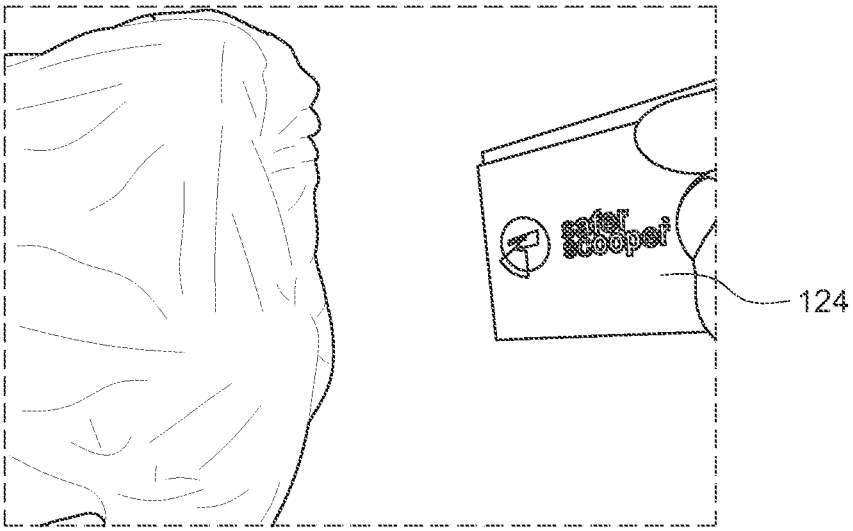
FIG. 11 is a plan view showing use of the animal waste collector of FIG. 7.

The body portion 102 includes a front wall 108, back wall 110, side walls 112 and 114, respectively, and a bottom wall 120. Front wall 108 is longer than back wall 110. Alternatively, front wall 108 may be the shorter wall as compared to back wall 110, in which case living hinge 106 should be located on the other wall. Making front wall 108 the longer wall is preferred however since it allows the longer front wall 108 to be used as a scoop. Side walls 112, 114 preferably are tapered to make it easy to slide the animal waste collector device into an out of a pocket. Referring to FIGS. 10 and 11, in use a bag 122 is loaded into and over the open end of the animal waste collector device 100, and the animal waste collector device 100 with the bag 122 is then positioned adjacent animal waste, and the animal waste collector device 100 is used as a scoop to pick up the animal waste. Alternatively, as shown in FIG. 11, a waste paddle or rigid card 124 may be used to sweep the animal waste into the open animal waste collector device. The bag may then be folded over or twisted or tied closed, and the top or lid 104 closed over the closed bag for subsequent disposal. Of course, the waste paddle or card may be dropped into the bag before the bag is closed and the animal waste collector device is closed over the closed bag.

Figure 12:
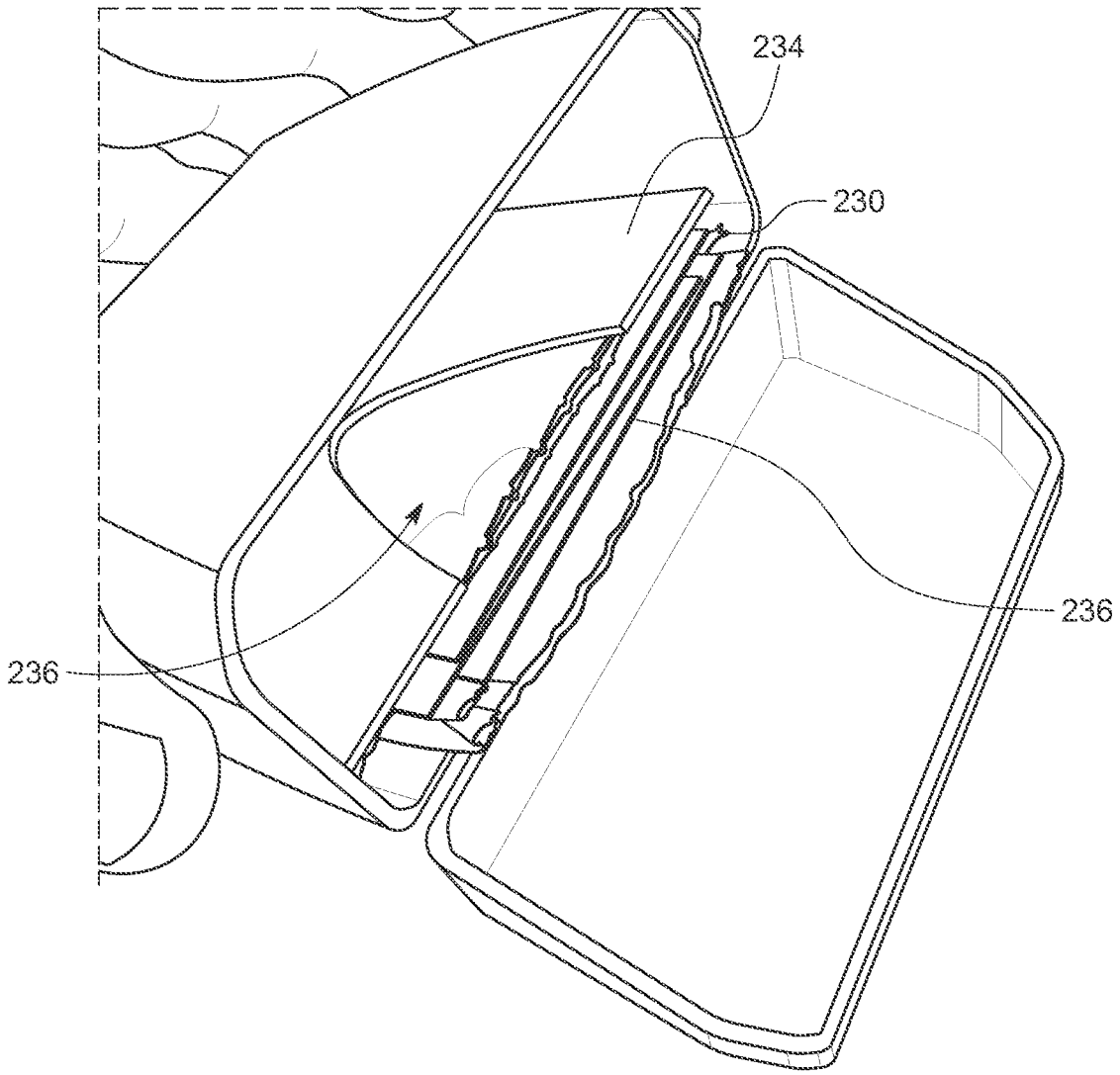
FIG. 12 is a perspective view of yet another embodiment of animal waste collector in accordance with the present disclosure.
Figure 15:
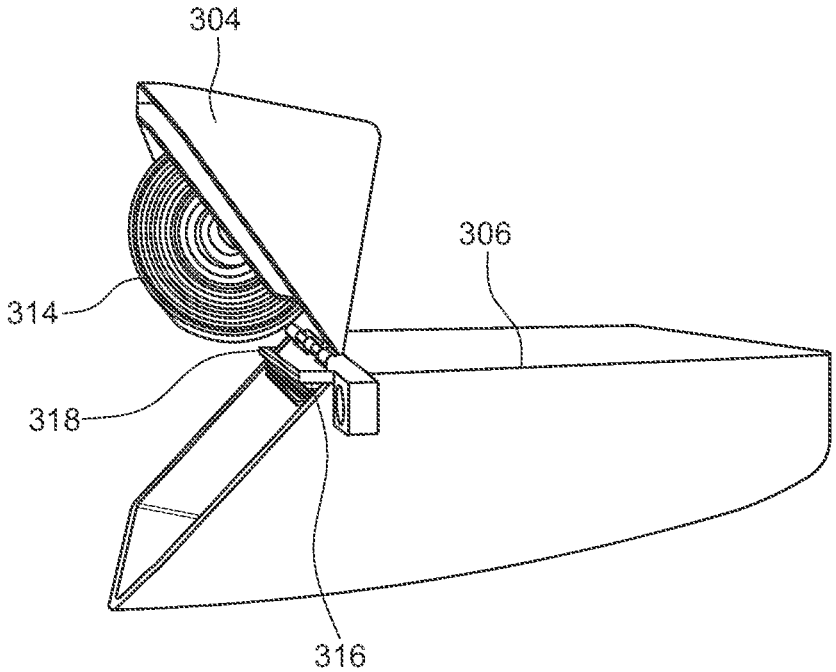
FIG. 15 is a side elevational view of the animal waste collector of FIG. 14.
Figure 16:
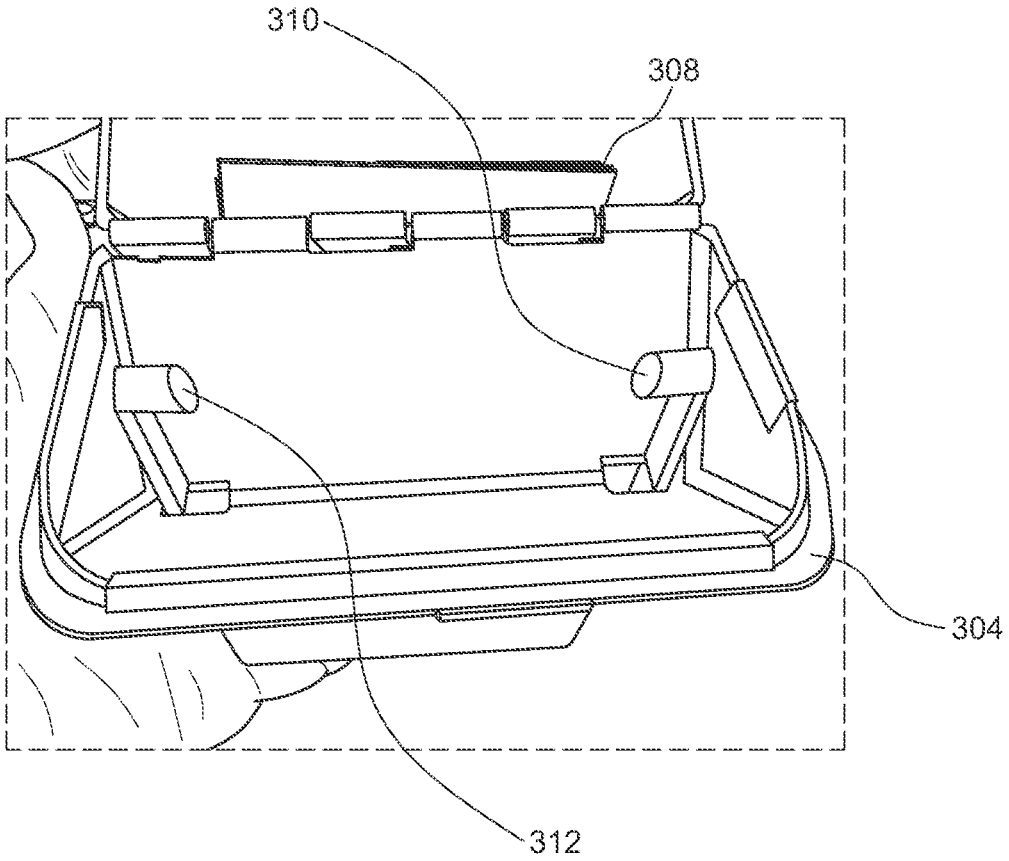
FIG. 16 is a view similar to FIG. 14, showing details of the interior of the lid of the FIG. 14 animal waste collector.
Figure 17:
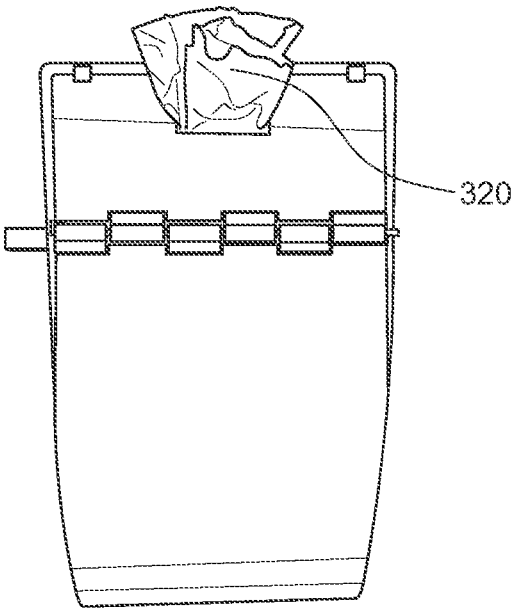
FIG. 17 is a view of the FIG. 14 animal waste collector from the back.

In yet another embodiment of animal waste collector device is shown in FIG. 12. The FIG. 12 embodiment is similar to the embodiment of FIGS. 7-9. However, the FIG. 12 embodiment includes an inner compartment formed by an inner wall 234 for holding a supply of paddles or cards, a supply of bags, or a supply of paddles and bags. To facilitate removal of the paddles and cards or bags or paddles and cards and bags, wall 234 is notched at 236. Alternatively, the cards may be slightly longer than wall 234 so that the cards extend beyond wall 234 as shown in FIG. 15 described below.

Yet another and preferred embodiment of the animal waste collection device of the subject disclosure is illustrated in FIGS. 14-17. The FIGS. 14-17 embodiment is in large part similar to embodiments of FIGS. 7-9 and 12. However, in the FIGS. 14-17 embodiment the lid 304 is rotatably hinged to the receptacle body 306 by a butt-type hinge 308. Also, a pair of roller spring clips 310, 312 are molded into the interior of lid 304 configured to hold a roll 314 of waste bags. As before, the waste bags are sized and shaped to fit over the open end of the hinged lid receptacle. As in the case of the FIG. 12 embodiment, the receptacle includes an inner wall 316 for holding a supply of rigid paddles or cards 318. Preferably the number of cards supplied will equal the number of bags on a supply roll.

In one embodiment, lid 304 has a opening 320 configured to permit the user to pull a bag through the opening. Alternatively lid 304 may have solid walls, and bags accessed one at a time by flipping open the lid.

Figure 13:
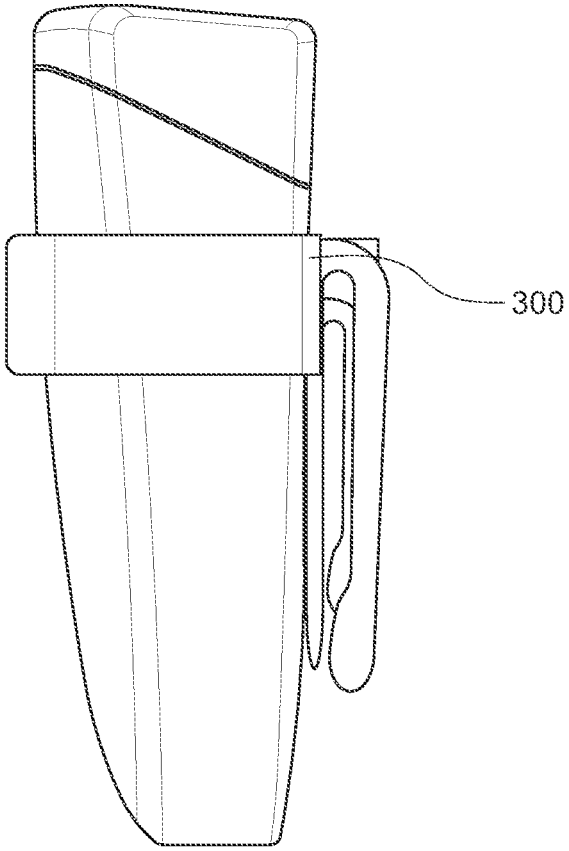
FIG. 13 is a side elevational view showing the animal waste collector of FIG. 8 fitted with a slip-on belt clip.
Figure 14:
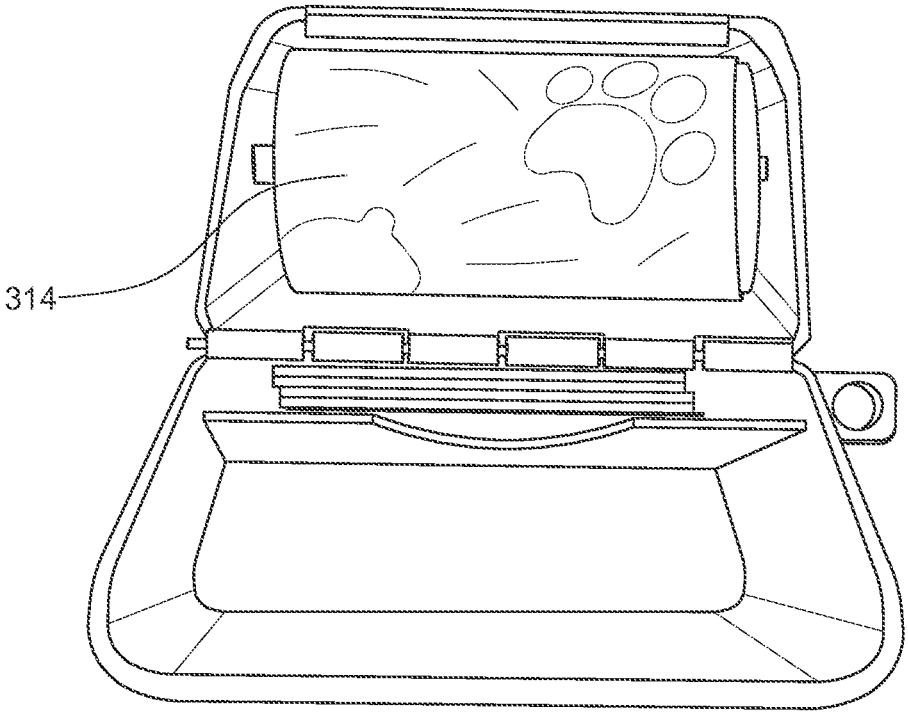
FIG. 14 is an end view of another embodiment of the animal waste collector in an open position.

Various changes may be made in the above disclosure without parting from the spirit and scope thereof. For example, while the animal waste collector device may be provided with a boss and ring clip 50 as shown in FIG. 2, for hanging from a person's belt, the animal waste collector device could be provided with a belt clip such as a slip-on belt clip 300 as shown in FIG. 13. Also, while the animal waste collector device preferably is formed of molded plastic, the animal waste collector device may be formed of light weight metal or rigid coated cardboard. Forming the animal waste collector device of cardboard has the advantage that the device could be disposable and recyclable. However, forming the animal waste collector device of cardboard would result in a device having sharp edges which would make it potentially more difficult to slide in and out of a user's pocket.

Yet other changes are possible.

It should be emphasized that the above-described embodiments of the present disclosure, particularly any "preferred" embodiments are merely possible examples of implementations set forth for a clear understanding of the principles of the disclosures. Many variations and modifications may be made to the above-described embodiments without departing substantially from the spirit and principles of the disclosures. All such modifications and variations are intended to be included herein within the scope of the disclosure.

The invention claimed is:

1. A compact animal waste collector kit comprising:

a hinged lid receptacle including a body and a hinged lid, sized and shaped to be hand-held and support an animal waste bag; and a supply of animal waste bags contained within an interior of said hinged lid receptacle, wherein each said animal waste bag is sized and shaped to fit over an open end of the hinged lid receptacle and in the hinged lid receptacle, wherein the hinged lid includes a pair of roller spring clips configured to hold said supply of animal waste bags on a roller;

and, a supply of removable rigid paddles or cards contained in a compartment formed within an interior of said hinged lid receptacle, wherein said compartment is formed by a dividing wall interior of the hinged lid receptacle.

2. The animal waste collector kit of claim 1, wherein the hinged lid receptacle includes a first compartment for holding the collected animal waste and a second compartment for storing spare animal waste bags.

3. The animal waste collector kit of claim 2, wherein the spare bags are in the form of a roll of plastic bags which are joined to one another via a perforation.

4. The animal waste collector kit of claim 1, wherein the hinged lid receptacle includes an eye hook or belt clip.

5. The animal waste collector kit of claim 4, wherein the belt clip is a slip-on belt clip.

6. The animal waste collector kit of claim 1, wherein the roll of animal waste bags comprises a plurality of plastic bags joined to one another in via a perforation.

7. The animal waste collector kit of claim 1, wherein the hinged lid includes a slot through which an animal waste bag may be threaded.

8. A method of collecting and storing animal waste comprising:

providing a hinged lid receptacle having a body and a hinged lid, sized and shaped to be hand held and support an animal waste bag, wherein the hinged lid includes a pair of roller spring clips holding a supply of animal waste bags on a roll, and wherein said hinged lid receptacle also includes a supply of rigid paddles or cards contained in a compartment formed within an interior of the hinged lid receptacle;

withdrawing an animal waste bag and a rigid paddle or card from said hinged lid receptacle and disposing said animal waste bag over an open end of the hinged lid receptacle and into the body of the hinged lid receptacle;

positioning the hinged lid receptacle with the animal waste bag approximate to a quantity of animal waste;

relocating the animal waste within the interior of the bag using the withdrawn rigid paddle or card;

folding, tying or twisting the bag closed; and closing the hinged lid receptacle.

9. The method of claim 8, wherein the hinged lid receptacle includes a first compartment for holding the collected animal waste and a second compartment for storing spare animal waste bags.

10. The method of claim 9, wherein the spare bags are in the form of a roll of plastic bags which are joined to one another via a perforation, or wherein the spare bags are folded and stacked on top of one another.

11. The method of claim 8, wherein the hinged lid receptacle includes a slot on an outer surface or a dividing wall interior of the hinged lid receptacle for holding one or more removable rigid paddles or cards.

12. The method of claim 8, wherein the hinged lid receptacle includes an eye hook or belt clip.

13. The method of claim 12, wherein the belt clip is a slip-on belt clip.

* * * * *